US007318507B2

(12) United States Patent
Fenton et al.

(10) Patent No.: US 7,318,507 B2
(45) Date of Patent: Jan. 15, 2008

(54) SUPPORT FOR SECONDARY BAG ON WHEELED LUGGAGE

(75) Inventors: Timm J. Fenton, Califon, NJ (US); Paul V. Scicluna, Penndel, PA (US); Alex Deng, Taichung County (TW)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 10/894,990

(22) Filed: Jul. 20, 2004

(65) Prior Publication Data

US 2005/0082131 A1 Apr. 21, 2005

Related U.S. Application Data

(60) Provisional application No. 60/489,605, filed on Jul. 24, 2003.

(51) Int. Cl.
*A45C 13/28* (2006.01)
*A45C 5/14* (2006.01)

(52) U.S. Cl. ..... 190/39; 190/18 A; 190/102; 190/108; 190/115; 16/113.1; 16/114.1

(58) Field of Classification Search ..... 190/15.1, 190/18 A, 102, 108, 115, 39; 16/113.1, 114.1; 280/37.655, 41.17
See application file for complete search history.

(56) References Cited

U.S. PATENT DOCUMENTS 2,581,417 A * 1/1952 Jones ..... 280/645
3,197,226 A * 7/1965 Erlinder ..... 280/646
4,036,336 A * 7/1977 Burtley ..... 190/18 A
4,538,709 A * 9/1985 Williams et al. ..... 190/18 A
4,759,431 A * 7/1988 King et al. ..... 190/18 A
4,792,025 A * 12/1988 Thomas ..... 190/18 A
5,167,306 A * 12/1992 Carrigan, Jr. ..... 190/18 A
5,335,759 A * 8/1994 Yeh ..... 190/115
5,575,362 A * 11/1996 Franklin et al. ..... 190/115
5,593,009 A * 1/1997 King ..... 190/102
5,690,196 A * 11/1997 Wang ..... 190/115
5,791,014 A * 8/1998 Wong ..... 16/113.1
5,927,450 A * 7/1999 Sadow ..... 190/102
5,934,425 A * 8/1999 Sadow ..... 190/115
6,148,477 A * 11/2000 Cheng ..... 16/113.1

(Continued)

FOREIGN PATENT DOCUMENTS

EP 0187318 A1 * 7/1986

(Continued)

*Primary Examiner*—Sue A. Weaver
(74) *Attorney, Agent, or Firm*—Baker Botts L.L.P.

(57) ABSTRACT

Stabilizing means for a secondary bag carried on a wheeled luggage case is attached to the telescoping handle assembly of the case. The handle assembly has a single telescoping tube and a stabilizing arm or arms pivotally mounted on the outer section of the telescoping tube. When the handle assembly is withdrawn from the case, the stabilizing arm or arms are pivoted to a horizontal position. On retraction of the handle into the case, the arm or arms are pivoted to a position parallel to the tube section. In another embodiment, collar affixed to the outer section of the tube carries a pair of L-shape members, each with a leg extending downwardly and parallel to the tube section. The collar and L-shaped arms move with the outer tube section into and out of the luggage case.

16 Claims, 6 Drawing Sheets

U.S. PATENT DOCUMENTS 6,186,295 B1 * 2/2001 Lin et al. ..... 190/18 A
6,202,254 B1 * 3/2001 Ezer ..... 16/113.1
6,237,734 B1 * 5/2001 Chen ..... 190/18 A
6,434,790 B1 * 8/2002 Chen ..... 16/113.1
6,464,245 B1 * 10/2002 Miles ..... 280/655.1
6,561,328 B1 * 5/2003 Huang ..... 190/18 A
6,591,951 B1 * 7/2003 Chen ..... 190/115
6,761,366 B1 * 7/2004 Klemmensen et al. ... 280/47.26
6,817,623 B1 * 11/2004 Gerutto ..... 280/655.1
2002/0096862 A1 * 7/2002 Fang ..... 280/652
2002/0125088 A1 * 9/2002 Nykoluk et al. ..... 190/18 A
2004/0026882 A1 * 2/2004 Brown ..... 280/47.34
2004/0182663 A1 * 9/2004 Hsien et al. ..... 190/108

FOREIGN PATENT DOCUMENTS

GB 2111917 A * 7/1983

* cited by examiner

SUPPORT FOR SECONDARY BAG ON WHEELED LUGGAGE

This application claims the benefit of U.S. Provisional patent application entitled SUPPORT FOR SECONDARY BAG ON WHEELED LUGGAGE, Ser. No. 60/489,605, and filed on Jul. 24, 2003.

TECHNICAL FIELD OF THE INVENTION

The present invention relates generally to luggage and more particularly to secondary bag supports for wheeled luggage.

BACKGROUND OF THE INVENTION

Wheeled luggage cases are in widespread use today and greatly ease the traveler's movement in airports, railroad stations, etc. Many wheeled luggage items have retractable handles that permit the traveler to pull or push the luggage item as he walks and have one hand free. A common type of such a handle comprises a pair of spaced, parallel tubes that telescope into the luggage case when not needed and can be readily withdrawn into an extended position when needed. A more recent variation on the retractable handle comprises a single retractable telescopic tubular member.

A common practice among travelers is to carry a secondary piece of luggage, such as a cosmetic case or brief bag, on the wheeled luggage case by seating it on top of the case and strapping it to the extended handle. With the double tube type of handle, some stability for the secondary bag is provided by the spaced tubes. However, even with that arrangement, especially when the tubes are closely spaced, rapid movement and turning of the wheeled luggage case can cause the secondary handle to slide or twist away from its desired position on the luggage case.

An arrangement for improving the stability of a secondary bag on a wheeled luggage item, applicable to luggage cases having closely spaced double tubes or single tube retractable handles is disclosed in U.S. patent application Ser. No. 10/394,291, filed Mar. 21, 2003, and assigned to the present assignee. That arrangement comprises a bar member mounted on the top of the luggage case and moveable between a collapsed position in which the bar member rests on the case and an extended position in which the bar member extends outwardly from the case just in front of the pull handle. The bar has considerable extent in the widthwise direction of the case, significantly more than the pull handle, and thereby provides stability to a secondary bag resting atop the case.

SUMMARY OF THE INVENTION

It is the object of the present invention to provide improved secondary bag supporting means for wheeled luggage which is mounted on and retractable with a single tube retractable handle.

In one preferred embodiment of the invention, the lowermost outer tube of the retractable handle is provided with grooves along opposed side edges. A pair of extendable arms is pivotally mounted in the grooves, one in each groove in the edges of the handle tube. In their unextended position, the arms are contained within the groove, enabling the handle tube and arms to be fully retracted and contained within the luggage case. When it is desired to mount a secondary bag on the case, the retractable handle is withdrawn and the arms are manually rotated out of the grooves in the tube section to their laterally extending positions. When so extended, the arms provide stabilizing support for the secondary bag.

In other preferred embodiments, stabilizing members are mounted on the exterior of the lower handle tube section and are moved into the luggage case when the handle is retracted.

It will be seen that the present invention provides a simple, effective way of providing stabilizing means for wheeled luggage cases having a single tube retractable handle.

BRIEF DESCRIPTION OF THE DRAWINGS

The foregoing and other objects, features and advantages of the invention will become apparent from the following detailed description thereof, taken in conjunction with the appended drawings, in which.

DETAILED DESCRIPTION OF THE INVENTION

Figure 1:
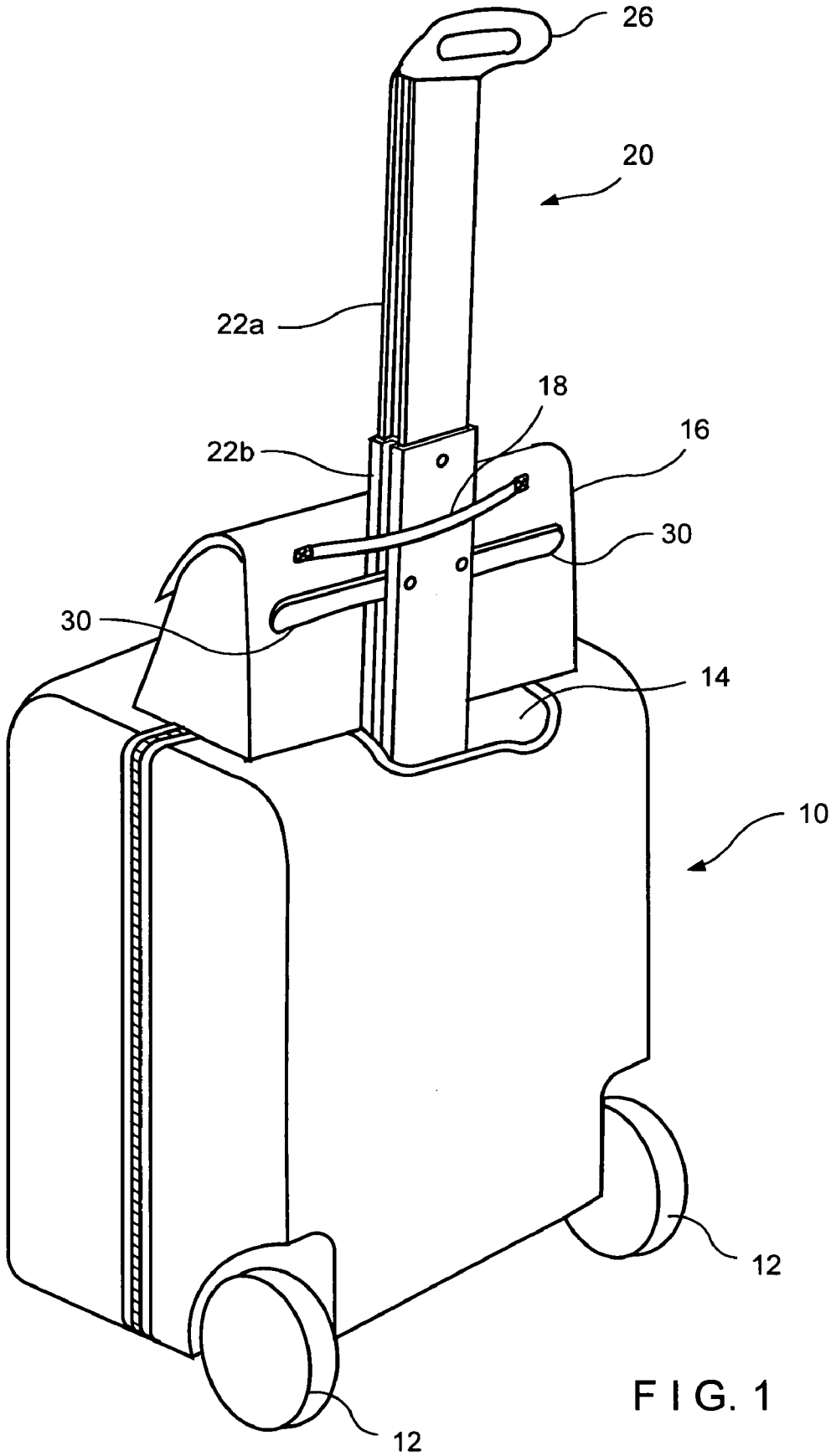
FIG. 1 is a perspective view of a wheeled luggage case incorporating one embodiment of the secondary bag support of the present invention.

In FIG. 1, a typical wheeled luggage case 10 has a part of wheels 12 and a retractable handle assembly, indicated generally at 20, and shown with the handle in its fully withdrawn or extended position. A suitable depressed portion 14 is provided in the luggage case for receiving the handle when retracted.

A secondary bag 16, such as a briefcase or cosmetic bag, is shown in position atop luggage case 10 for movement therewith. A strap or tie 18, which may be of any suitable type, either separate from or affixed to bag 16, is slipped over or around the handle tube to retain the bag 16 atop case 10.

As shown in FIG. 1, handle assembly 20 comprises a telescoping tube 22*a* and 22*b*, of generally rectangular cross-section and a handgrip 26 at the upper end of tube section 22*a*. As will be discussed in greater detail below, a pair of arms 30 extend outwardly from opposite edges of tube section 22*b* for providing stabilizing support for secondary bag 16.

Figure 2:
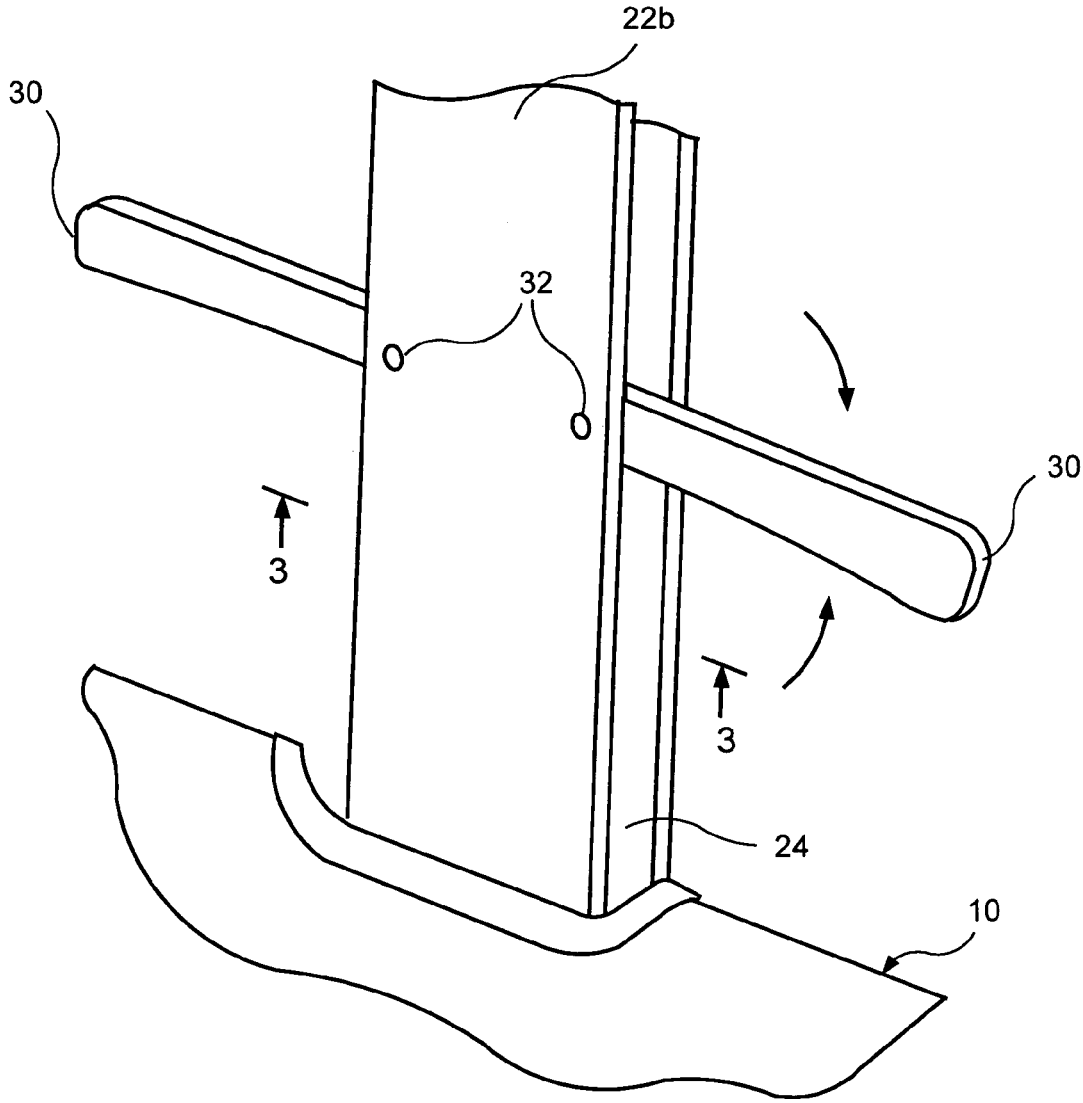
FIG. 2. is an enlarged partial view of the luggage case of FIG. 1. showing the secondary bag support in greater detail.
Figure 3:
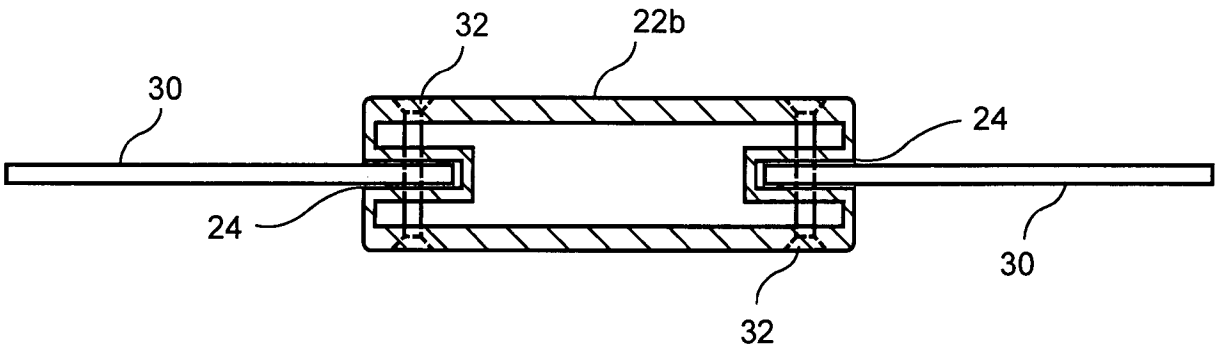
FIG. 3 is a cross-sectional view of the secondary bag support of the invention, taken along the line 3-3 of FIG. 2.

Turning now to FIGS. 2 and 3, telescoping tube section 22*b* is formed with longitudinal recesses or channels 24 extending along its opposite narrow edges. It will be understood of course that tube section 22*a* will be similarly shaped in cross-section to slidably fix within section 22*b*.

Arms 30 each have one end pivotally secured in respective edge recesses 24 by fasteners 32, the heads of which do not extend appreciably above the surfaces of tube section 22*b*. Suitable detent means (not shown) keep arms 30 in their extended or retracted positions. When the handle assembly 20 is to be retracted into case 10, arms 30 are flipped, either up or down as indicated by the arrows, into their respective recesses 24. When handle assembly 20 is withdrawn and a secondary bag is to be carried on the luggage case 10, arms 30 are manually moved to their horizontal position as shown.

Figure 4:
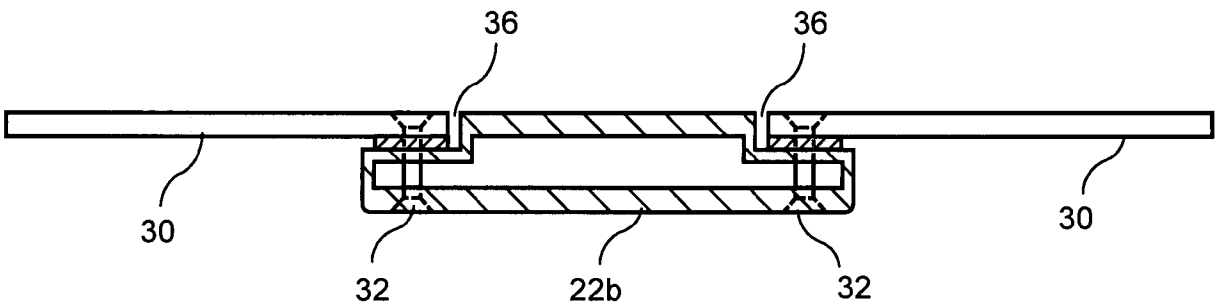
FIG. 4 is a cross-sectional view of an alternate embodiment of the secondary bag support of the invention.

In the embodiment of FIG. 4, recesses 36 are formed along the front of a side wall of tube 22*b*, adjacent each edge to accommodate arms 30, rather than in the edges. The embodiments of FIGS. 3 and 4 are otherwise the same.

Figure 5:
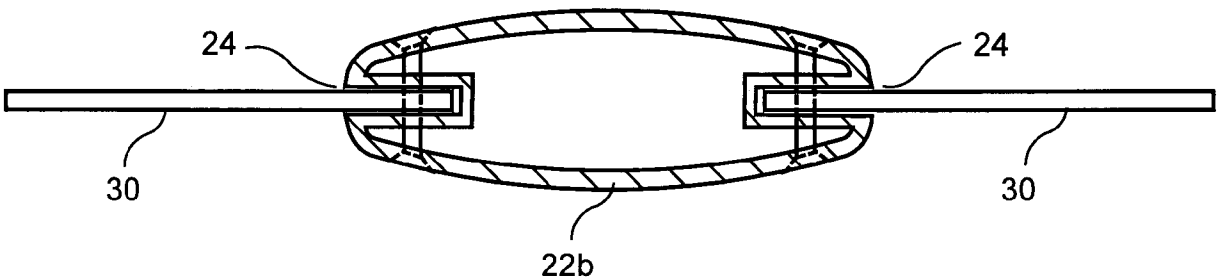
FIG. 5 is a cross-sectional view illustrating use of the invention with a non-rectangular retractable handle tube.

Similarly, FIG. 5 illustrates an embodiment of the invention in which the telescoping section of the handle assembly is not rectangular in cross-section, but is generally elliptical, for example.

Figure 6:
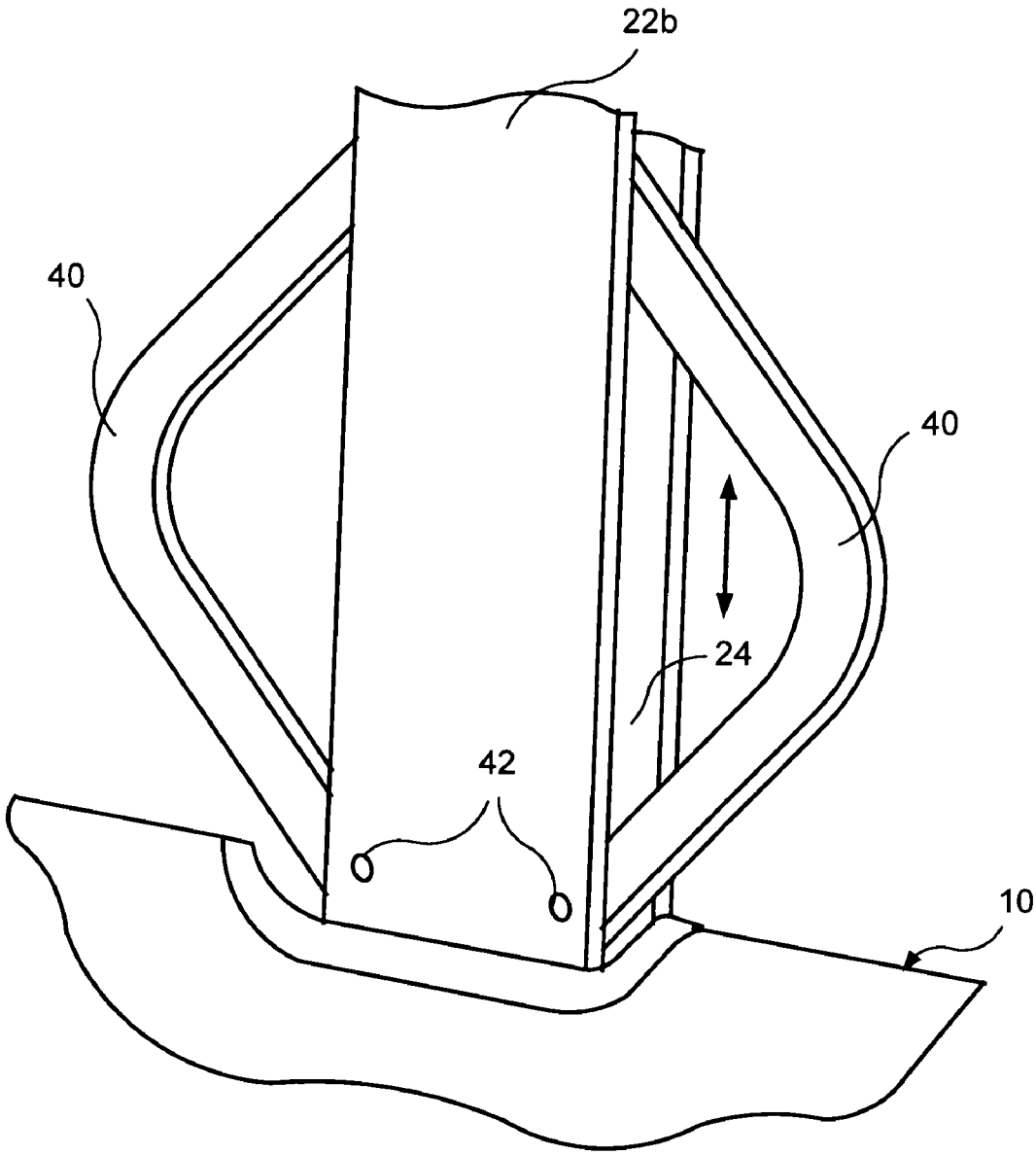
FIG. 6 is a partial perspective view showing an alternative embodiment of the invention.

A further embodiment of the invention is illustrated in FIG. 6. In this embodiment, arms 30 are replaced with a pair of bow spring members 40, secured at one end within recesses 24 of section 22*b* by rivets or the like 42. Spring members 40 assume their normal extended position as shown when the handle 20 is extended, providing lateral support for a secondary bag. When retracting the handle, the spring members 40 are squeezed into recesses 24 as the tube section 24 is pushed into luggage case 10. When the handle is withdrawn, spring members 40 automatically pop out into their extended position as soon as section 22*b* clears the luggage case.

Figure 7:
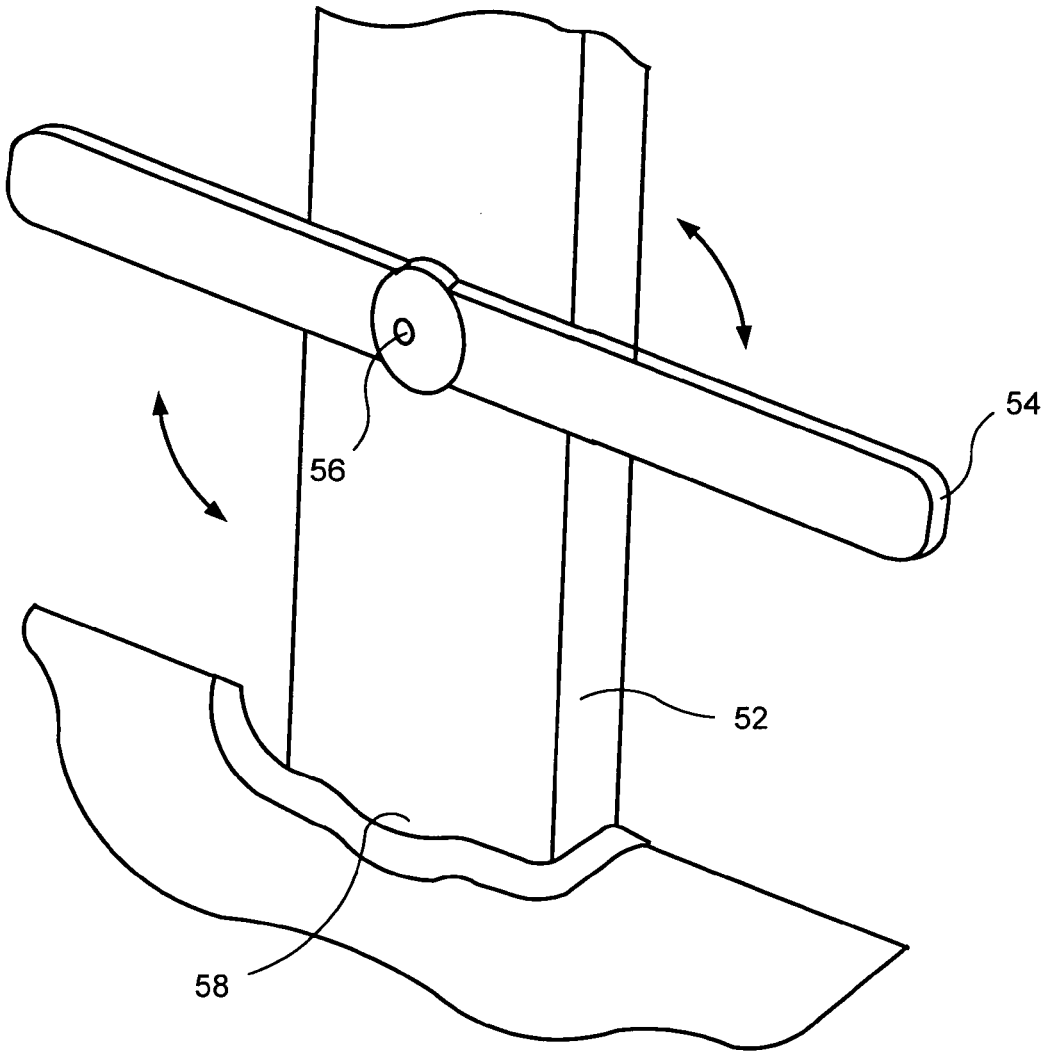
FIG. 7 is a partial perspective view showing another embodiment of the invention.

Another embodiment of the invention, not requiring recesses in the edges of the handle tube is shown in FIG. 7. In this embodiment, the lower section 52 of the telescoping handle is formed without recesses and arm 54 is pivotally mounted at its center by rivet or other suitable fastener 56 on the surface of the inner wide wall of section 52. Suitable friction or other detent means are provided to retain arm 54 in any manually set position. As indicated by the arrows, arms 54 may be rotated between its horizontal stabilizing position as shown to a vertical position along tube section 52 for retraction of the handle. An appropriate enlargement 58 of the handle receiving opening in the case is provided to accommodate arm 54 when the handle is retracted.

Figure 8:
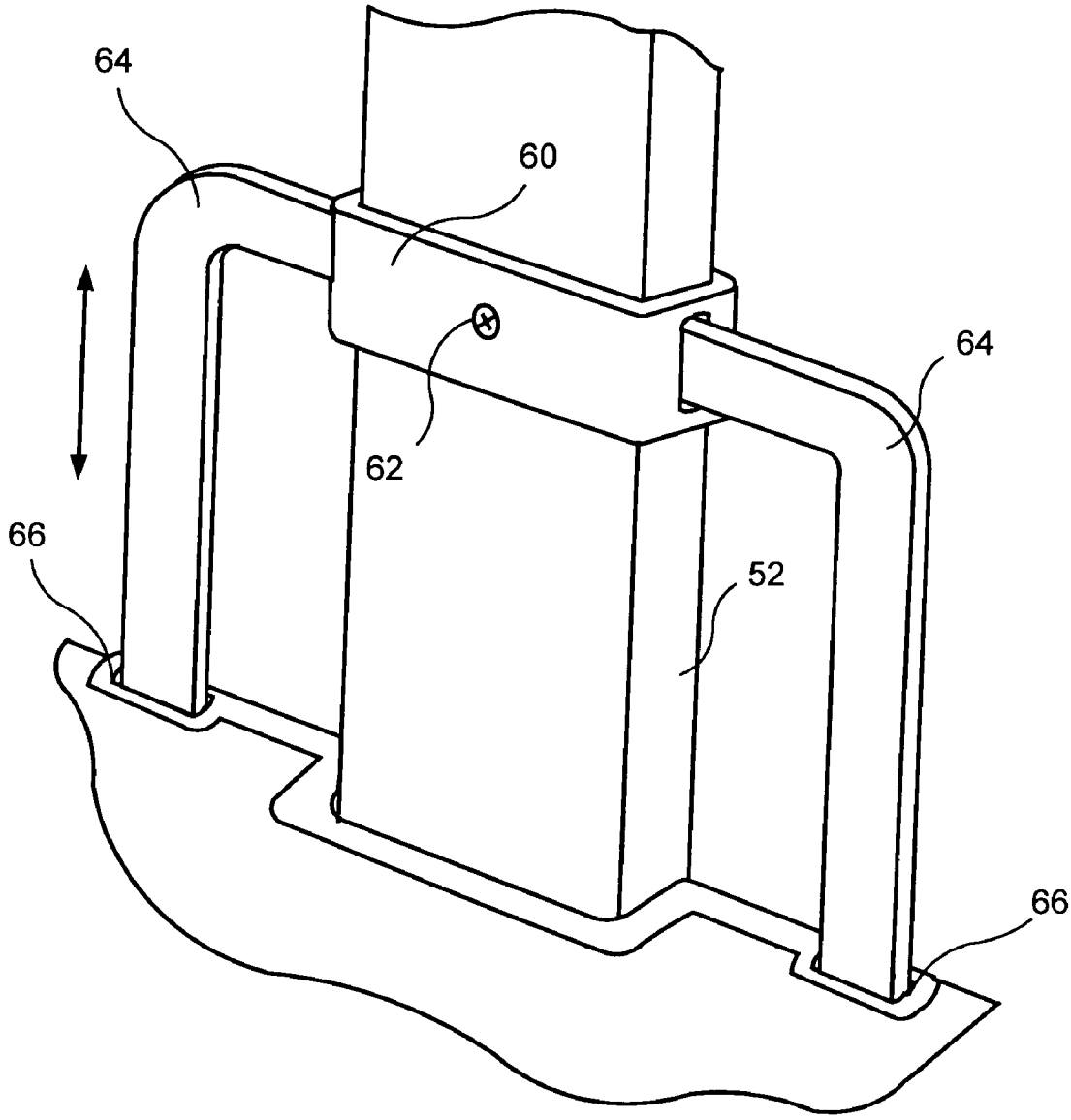
FIG. 8 is a partial perspective view of still another embodiment of the invention.

In the embodiment of FIG. 8, a collar 60 surrounds tube section 52 and is rigidly affixed thereto by one or more set screws 62, which do not pass through the wall of section 52. Extending from each end of collar 60 is an L-shaped member 64 having its downwardly extending leg of a length such that with the handle fully extended as shown, it extends below the upper surface of the luggage case via openings 66. When the luggage handle is retracted, members 64 and collar 60 are lowered into the case along with tube section 52.

The various components described above may be manufactured from suitable metals or plastics having the requisite strength characteristics, as will be understood by those skilled in the art.

It will be seen from the foregoing that in each of the above-described embodiments of the invention, secondary bag stabilizing structure is carried by the telescoping tube of the pull handle assembly, with minor or no modification of the luggage case. This feature simplifies manufacture of the luggage case and uses very little if any additional space within the case. Thus, secondary bag stabilization is achieved without major structural modification of the case or loss of carrying capacity.

It will be understood that although the invention has been described by reference to specific embodiments thereof, many alternatives, modifications and variations thereof will occur to those skilled in the art without departing from the inventive concepts disclosed. All such alternatives, modifications and variations, therefore, are intended to be included within the spirit and scope of the appended claims.

We claim:

1. A wheeled luggage item comprising:

a case having wheels at a lower end thereof;

a telescoping tube having one end secured within said case and adapted to be withdrawn from and retracted into said case through an upper end thereof;

a handle mounted on the other end of said telescoping tube; and at least one member at least substantially permanently mounted on and extending generally perpendicular to said telescoping tube for supporting a secondary bag carried on the upper end of said case, said at least one member being retractable into said case with said tube.

2. The wheeled luggage item of claim 1 wherein said telescoping tube comprises inner and outer sections, said outer section having its lower end secured within said case and said inner section adapted to be received within said outer section in a telescoping relation.

3. The wheeled luggage item of claim 2 wherein said outer section is provided with recesses on either side of said outer section configured to receive said at least one member, said recesses extending longitudinally along opposite edges of said outer.

4. The wheeled luggage item of claim 3 wherein said outer section is generally rectangular in cross-section.

5. The wheeled luggage item of claim 3 wherein said outer section is generally elliptical in cross-section.

6. The wheeled luggage item of claim 3, wherein said at least one rigid member includes a pair of elongated supporting members, each supporting member being movable to a position within the recesses of the outer section.

7. The wheeled luggage item of claim 1 wherein said at least one member comprises a single elongated supporting member pivotally mounted at the center of said telescoping tube on said outer section and movable between positions parallel and perpendicular to said telescoping tube.

8. The wheeled luggage item of claim 1 wherein said at least one member comprises a pair of L-shaped members secured to said telescoping tube, the L-shaped member including a short arm and a long arm, the short arm of each L-shaped member having an end-fixed to said telescoping tube and extending perpendicular to said outer section, the long arm of said L-shaped member extending downwardly from another end of the short arm and parallel to said outer section, said L-shaped member being withdrawable from and retractable into said case with said telescoping tube.

9. The wheeled luggage item of claim 8, further comprising a collar fixedly mounted on said outer section and the pair of L-shaped members rigidly fastened to said collar at the opposite edges of said outer section such that the short arm of each L shaped member has an end fixed to said collar, said collar and L-shaped members being withdrawable from and retractable into said case with said outer section.

10. A wheeled luggage item comprising:

a case having wheels at a lower end thereof;

a telescoping tube having one end secured within said case and adapted to be withdrawn from and retracted into said case through an upper end thereof;

a handle mounted on the other end of said tube; and at least one substantially rigid member mounted to said telescoping tube for supporting a secondary bag carried on the upper end of said case, said at least one substantially rigid member being retractable into said case with said telescoping tube.

11. The wheeled luggage item of claim 10 wherein said telescoping tube comprises inner and outer sections, said outer section having its lower end secured within said case and said inner section adapted to be received within said outer section, and wherein said at least one substantially rigid member is mounted on said outer section.

12. The wheeled luggage item of claim 10 wherein said wheeled luggage comprises only one said telescoping tube.

13. A wheeled luggage item comprising:

a case having wheels at a lower end thereof;

only one telescoping tube having one end secured within said case and adapted to be withdrawn from and retracted into said case through an upper end thereof;

a handle mounted on the other end of said tube; and at least one substantially rigid member attached to said case for supporting a secondary bag carried on the upper end of said case, said at least one substantially rigid member being retractable into said case, wherein said telescoping tube comprises inner and outer sections, said outer section having its lower end secured within said case and wherein said at least one substantially rigid member is affixable to said outer section.

14. The wheeled luggage item of claim 13 wherein said outer section is generally rectangular in cross-section.

15. The wheeled luggage item of claim 13 wherein said outer section is generally elliptical in cross-section.

16. A wheeled luggage item comprising:

a case having wheels at a lower end thereof;

a telescoping tube having one end secured within said case and adapted to be withdrawn from and retracted into said case through an upper end thereof;

a handle mounted on the other end of said telescoping tube; and at least one member as least substantially permanently mounted on said telescoping tube for supporting a secondary bag carried on the upper end of said case, said at least one member being retractable into said case with said tube, wherein said telescoping tube comprises inner and outer sections, said outer section having its lower end secured within said case and wherein said at least one member is mounted on said outer section, wherein said at least one member comprises a single elongated supporting member pivotally mounted at the center of said telescoping tube on said outer section and movable between positions parallel and perpendicular to said telescoping tube.

* * * * *